US011605488B2

(12) United States Patent
Goepfert et al.

(10) Patent No.: US 11,605,488 B2
(45) Date of Patent: Mar. 14, 2023

(54) HIGH-VOLTAGE DEVICE HAVING CERAMIC SPACER ELEMENTS, AND USE THEREOF

(71) Applicant: SIEMENS AKTIENGESELLSCHAFT, Munich (DE)

(72) Inventors: Robert Goepfert, Roedental (DE); Sebastian Mueller, Zapfendorf (DE)

(73) Assignee: Siemens Aktiengesellschaft, Munich (DE)

( * ) Notice: Subject to any disclaimer, the term of this patent is extended or adjusted under 35 U.S.C. 154(b) by 273 days.

(21) Appl. No.: 16/647,595

(22) PCT Filed: Sep. 13, 2018

(86) PCT No.: PCT/EP2018/074683
§ 371 (c)(1),
(2) Date: Mar. 16, 2020

(87) PCT Pub. No.: WO2019/063300
PCT Pub. Date: Apr. 4, 2019

(65) Prior Publication Data

US 2020/0219642 A1 Jul. 9, 2020

(30) Foreign Application Priority Data

Sep. 27, 2017 (DE) ..... 102017217150

(51) Int. Cl.
*H01F 27/04* (2006.01)
*H01F 27/08* (2006.01)
(Continued)

(52) U.S. Cl.
CPC ..... *H01F 27/04* (2013.01); *H01F 27/08* (2013.01); *H01F 27/29* (2013.01); *H01F 38/30* (2013.01)

(58) Field of Classification Search
CPC ..... H01F 27/04; H01F 27/08; H01F 27/29; H01F 38/30
See application file for complete search history.

(56) References Cited

U.S. PATENT DOCUMENTS 1,160,960 A * 11/1915 Thordarson ..... H02H 9/02 336/225
3,525,908 A 8/1970 Allmendinger
(Continued)

FOREIGN PATENT DOCUMENTS

CN 1351417 A 5/2002
CN 101577154 A 11/2009
(Continued)

*Primary Examiner* — Tuyen T Nguyen
(74) *Attorney, Agent, or Firm* — Laurence A. Greenberg; Werner H. Stemer; Ralph E. Locher

(57) ABSTRACT

A high-voltage device includes a housing and at least one subassembly which is electrically insulated from the housing. The at least one subassembly is spaced from the housing and mechanically connected to the housing. At least one ceramic spacer element is disposed between the housing and the at least one subassembly. A method of using the high-voltage device includes transferring heat, which is produced at connection elements of the at least one subassembly which is electrically insulated from the housing, from the subassembly through the at least one ceramic spacer element to the housing and emitting the heat from the housing to the environment.

19 Claims, 1 Drawing Sheet

(51) Int. Cl.
*H01F 27/29* (2006.01)
*H01F 38/30* (2006.01)

(56) References Cited

U.S. PATENT DOCUMENTS

| | | | |
|---|---|---|---|
| 4,144,402 | A | 3/1979 | Klug et al. |
| 4,975,671 | A | 12/1990 | Dirks |
| 5,956,231 | A | 9/1999 | Yamada et al. |
| 6,650,559 | B1 | 11/2003 | Okamoto et al. |
| 10,381,148 | B2 | 8/2019 | Chida et al. |
| 2013/0033349 | A1 | 2/2013 | Takano et al. |

FOREIGN PATENT DOCUMENTS

| | | | | |
|---|---|---|---|---|
| CN | 201556501 | U | | 8/2010 |
| CN | 102117690 | A | | 7/2011 |
| CN | 102360890 | A | * | 2/2012 |
| CN | 104240908 | A | | 12/2014 |
| CN | 104319062 | A | | 1/2015 |
| CN | 106463244 | A | | 2/2017 |
| DE | 2847129 | A1 | | 5/1980 |
| DE | 102014200762 | A1 | | 7/2015 |
| DE | 112015000785 | T5 | | 11/2016 |
| EP | 1283589 | A2 | | 2/2003 |
| EP | 2117015 | A1 | | 11/2009 |
| RU | 2297063 | C2 | | 4/2007 |
| WO | WO2014108498 | A1 | | 7/2014 |
| WO | 2015193252 | A1 | | 12/2015 |
| WO | WO2016030271 | A1 | | 3/2016 |

* cited by examiner

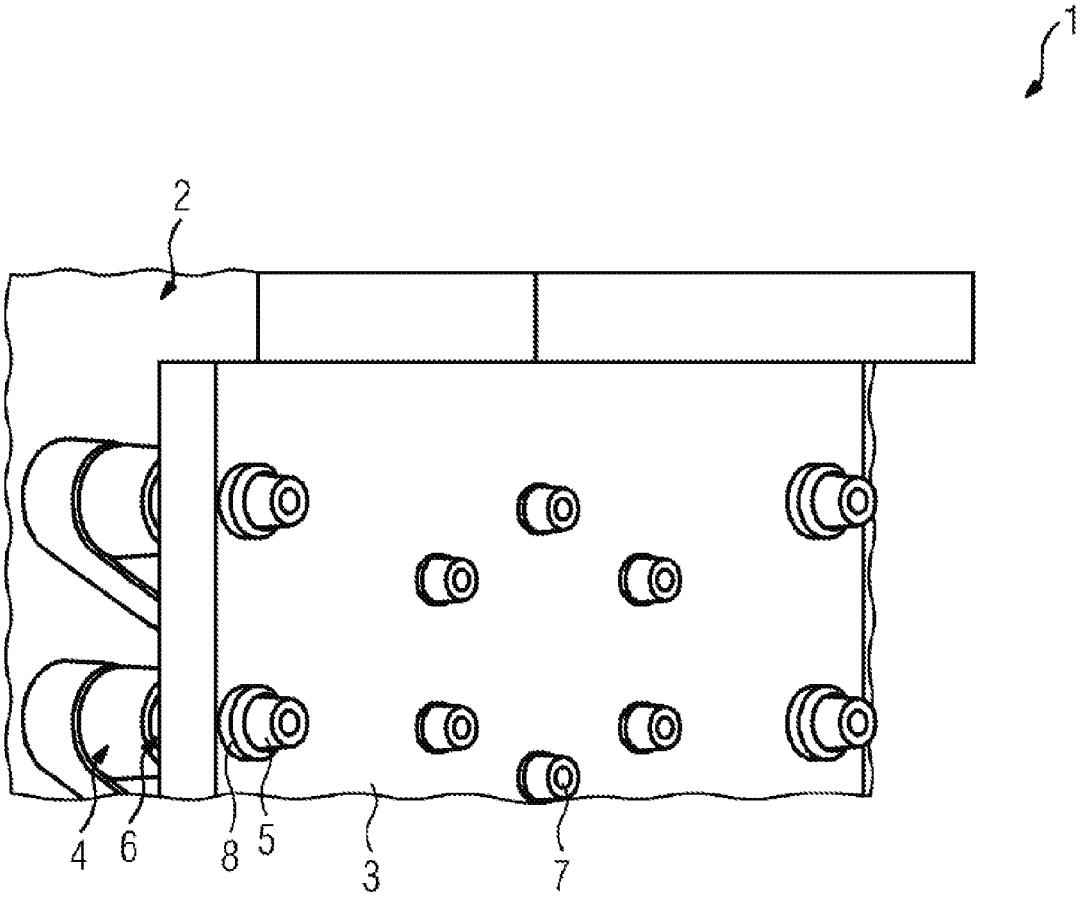
1
2
4
6
8
5
3
7

HIGH-VOLTAGE DEVICE HAVING CERAMIC SPACER ELEMENTS, AND USE THEREOF

BACKGROUND OF THE INVENTION

Field of the Invention

The invention relates to a high-voltage device having a housing and at least one subassembly electrically insulated from the housing. The at least one subassembly is arranged in a manner spaced apart from the housing and is mechanically connected to the housing. The invention furthermore comprises the use of the high-voltage device described above.

High-voltage devices, in particular instrument transformers for voltages of up to 1200 kV and/or a few thousand amps, are known e.g. from U.S. Pat. No. 3,525,908. A housing, e.g. arranged on an insulator, comprises three-dimensional devices, such as e.g. coils for measuring high voltages and/or currents. The coils are arranged around a conductor in the housing, to which conductor high voltages are applied and/or through which conductor high currents to be measured flow, the housing being filled with an electrically insulating medium, e.g. oil, $SF_6$ and/or clean air. The conductor is in electrical contact with connections on the insulator and/or on the housing that are electrically insulated from the housing. The connections are designed for connecting electrical lines of electrical supply systems, electrical loads and/or electricity generators. During use, high currents in the region of a few thousand amps flow via the conductor from one to the other connection. The high currents in this case can lead to an intense production of heat on the connections.

The housing is electrically insulated from the connections and/or connectable or connected electrical lines. The connections are e.g. in the form of an insulated subassembly on the housing, in particular in the form of a metal plate. The surface of the metal plate allows cooling with the ambient air and dissipation of the heat to the surroundings or environment. In order to reduce heating of the connections, a design made of copper, in particular with a coating made of nickel, is possible. This results in high costs and the limited outer surface of the connections results in limited dissipation of heat to the surroundings. In the event of high primary currents, heating above permissible limit values for a temperature can occur and adequate dissipation of heat via the connections may be impossible.

SUMMARY OF THE INVENTION

It is an object of the present invention to specify a high-voltage device and a use thereof that avoid the problems described above. In particular, it is an object to specify a high-voltage device whose connections can be produced inexpensively, easily, in mechanically robust fashion and compactly in the form of at least one electrically insulated subassembly, with high possible dissipation of heat from the insulated subassembly at the same time.

The indicated object is achieved according to the invention by a high-voltage device and/or by the use of the high-voltage as described below. Advantageous configurations of the high-voltage device according to the invention and the use thereof are specified in the subclaims. Subjects of the main claims are combinable with one another and with features of subclaims, and features of the subclaims are combinable with one another.

A high-voltage device according to the invention comprises a housing and at least one subassembly electrically insulated from the housing. The at least one subassembly is arranged in a manner spaced apart from the housing and is connected to the housing in mechanically robust fashion, in particular. Arranged between the housing and the at least one subassembly is at least one ceramic spacer element.

The arrangement of the at least one subassembly in a manner spaced apart from the housing, with at least one ceramic spacer element between the housing and the at least one subassembly, allows good electrical insulation of the at least one subassembly from the housing, with simultaneously good heat transfer or thermal conductivity via the at least one ceramic spacer element. Heat produced on connections of the high-voltage device in the form of the at least one subassembly e.g. in the event of a large flow of current can be effectively transferred to the housing via the at least one ceramic spacer element. The housing serves as a cold surface, with a large surface area that allows good dissipation of heat to the environment. The electrically insulated subassembly can be used to make electrical contact with elements or components of the high-voltage device, in particular inside the housing, with the electrically insulated subassembly forming an inexpensive, simple, mechanically robust and compact connection or a connecting element.

The ceramic spacer element can be a ceramic disk and/or a ceramic sleeve and/or a ceramic plate, in particular clamped, in particular in hollow cylindrical form with a circular base, and/or with a continuous opening along a central axis. The at least one subassembly can be secured to the housing with the aid of securing means, in particular with the aid of screws and/or securing means electrically insulated from the subassembly. Ceramic disks and/or ceramic sleeves and/or ceramic plates that have an, in particular continuous, in particular circular and/or rectangular, opening in the center can be used to secure the at least one subassembly to the housing via screws effectively, i.e. in mechanically robust and electrically insulated fashion, the screws each being able to be passed through the continuous, in particular circular, opening in the ceramic disk and/or ceramic sleeve. The ceramic disks and/or ceramic sleeves maintain a fixed, mechanically robust distance between the at least one subassembly and the housing, and permit electrical insulation of the at least one subassembly from the housing with simultaneously good heat exchange between the at least one subassembly and the housing. This has the associated advantages described above.

The ceramic spacer element can have a high electrical resistance and a high coefficient of thermal conductivity. This ensures good electrical insulation of the at least one subassembly from the housing, with simultaneously good heat exchange between the at least one subassembly and the housing.

At least one electrical contact-connection element, in particular at least one screw, can be comprised, for making electrical contact between the at least one subassembly and at least one element of the high-voltage device inside the housing. The high-voltage device can be designed in the style of an instrument transformer. Electrical elements in the instrument transformer, i.e. in the housing, e.g. conductors, coils and/or capacitors, can be in electrical contact with the outer connection or the at least one subassembly, and in particular electrical lines and/or conductor rails connected thereto, via the at least one electrical contact-connection element, in particular via the at least one screw.

The at least one subassembly electrically insulated from the housing can comprise at least one connecting element for connecting electrical lines and/or conductor rails, in particular for electrical connection to electrical supply system lines, electrical loads and/or electricity generators. This allows a high-voltage device to be electrically connected in order to perform a predetermined function according to the type of device.

The at least one subassembly electrically insulated from the housing can comprise at least one plate-shaped element, in particular at least one parallelepipedal plate and/or an L-shaped element made up of plate-shaped elements. Both connecting elements and contact-connection elements can be effectively arranged on, in and/or atop the plate-shaped element, and good electrical contact between elements can be produced easily and inexpensively via the plate-shaped element.

The at least one subassembly electrically insulated from the housing can be made of a metal, in particular of copper and/or steel and/or can comprise a metal, in particular copper and/or steel and/or alloys. This produces good electrical conductivity and thermal conductivity via the subassembly electrically insulated from the housing, with the advantages described above.

The housing, in particular a cylindrical housing, can be made of a metal, in particular cast iron, and/or can comprise a metal, in particular cast iron. This produces good thermal conductivity via the housing, and heat produced on the subassembly electrically insulated from the housing, e.g. on the electrical connections and/or connecting surfaces with connecting elements and/or contact-connection elements and in the subassembly itself, in the current-carrying state, can be emitted to the environment effectively via the housing and in particular effectively via a large surface of the housing.

The at least one ceramic spacer element can be made of an aluminum oxide, silicon carbide, boron nitride or aluminum nitride ceramic and/or can comprise an aluminum oxide, silicon carbide, boron nitride or aluminum nitride ceramic. These have a high thermal conductivity, in particular greater than 30 or greater than 100 W (m×K), and a low electrical conductivity or a high specific resistance, in particular greater than $10^{12}$ ohm-meters or greater than $10^{10}$ ohm-meters at 20° C. This produces good electrical insulation between the housing and the subassembly electrically insulated from the housing, with good thermal conductivity or discharge of excess heat via the ceramic spacer element.

Use, according to the invention, of the high-voltage device described above involves heat produced on connecting elements of the at least one subassembly electrically insulated from the housing, in particular for connecting electrical lines and/or conductor rails, being transferred from the subassembly to the housing via the at least one ceramic spacer element and being emitted from the housing to the environment.

Electrical contact between the at least one subassembly electrically insulated from the housing and elements in the housing, in particular transformer parts, can be made via at least one electrical contact-connection element, in particular via at least one screw, in particular having a current-carrying capacity in the region of a few thousand amps.

The advantages of the use, in accordance with the invention, of the high-voltage device are analogous to the advantages described above of the high-voltage device according to the invention, and vice versa.

An exemplary embodiment of the invention is depicted schematically in the single FIGURE hereinafter and is explained in more detail below.

BRIEF DESCRIPTION OF THE SINGLE VIEW OF THE DRAWING

For this:

The FIGURE schematically shows an oblique view of a portion of a housing 2 of a high-voltage device 1 according to the invention, with a subassembly 3 that is electrically insulated from the housing 2 and spaced apart from the housing 2 via ceramic spacer elements.

DETAILED DESCRIPTION OF THE INVENTION

The single FIGURE depicts an oblique view of a portion of a housing 2 of a high-voltage device 1 according to the invention, with a subassembly 3 spaced apart from the housing 2. The subassembly 3 serves as connection or connecting element of the high-voltage device 1, to which e.g. electrical lines, conductor rails and/or devices, such as e.g. electrical loads and/or electricity generators, are connected. These can be e.g. screwed, soldered, welded and/or clamped to the subassembly 3. The subassembly 3 has the shape of a plate, in particular an angled plate. An angle of 90° is formed by two portions of the plates, each portion being in parallelepipedal form. The angled portion of the plate points away from the housing 2, in particular perpendicularly away from the adjacent housing surface, the other portion of the plate being arranged parallel to the adjacent housing surface.

The subassembly 3 spaced apart from the housing 2 is e.g. made of steel, copper and/or coated with nickel. For reasons of cost, cheaper materials such as e.g. aluminum and/or cast iron can also be used. The housing 2 is made of a metal, e.g. steel, cast iron, copper and/or aluminum. The housing 2 and the subassembly 3 are each in electrically conductive and thermally conductive form. The small surface of the subassembly 3 means that the subassembly 3 emits little heat directly to the environment, e.g. the ambient air. The large surface of the housing 2 means that it is capable of emitting large amounts of thermal energy to the surroundings or environment, and can therefore serve as a cold surface.

The high-voltage device 1 according to the invention is e.g. an instrument transformer, in particular a current transformer for measuring currents in high-voltage lines. An insulator, e.g. a ribbed, columnar ceramic and/or silicone insulator, which serves as support and is not depicted in the FIGURE for the sake of simplicity, has a housing 2 arranged on it. The housing 2 is e.g. spherical or pot-shaped, with a substantially circular or quadrangular bottom. Opposite sides each have a subassembly 3 arranged on them, spaced apart from the housing 2, e.g. with a connected overhead line. The high-voltage device 1 according to the invention is e.g. electrically connected between the high-voltage line in order to measure the current via the high-voltage line. Voltages of up to 1200 kV and currents of a few thousand amps may be present on the high-voltage device 1 according to the invention, or can flow via the high-voltage device 1 according to the invention, in this case.

To measure high currents, in particular, there are e.g. coils arranged in the housing 2 around a conductor, which are able to be used to measure the current in the line, in particular inductively. The conductor in the housing 2, which is not depicted in the FIGURE for the sake of simplicity, is electrically connected to the subassembly 3 via electrical contact-connection elements 7. E.g. screws and/or bolts, e.g. made of copper and/or steel, and/or in particular weld joints, electrically insulated from the housing 2, can be routed through the housing 2 from inside to outside and can electrically connect the conductor to the subassembly 3. In the FIGURE, in exemplary fashion, six screws as electrical contact-connection elements 7 are arranged in the plate-shaped portion of the subassembly 3 that is arranged parallel to the housing 2, i.e. are screwed and/or routed through the plate, and electrically insulated from the housing, routed through the housing 2 from outside to inside and electrically connected to the conductor in the housing 2.

The subassembly 3 electrically insulated from the housing 2 is connected to the housing 2 in mechanically robust fashion via securing means 5, i.e. e.g. is screwed to the housing 2. In the exemplary embodiment of the FIGURE, there is provision on the housing 2 for bushes 4 having e.g. internal threads in which the screws 5 are screwed to secure the subassembly 3. Four screws 5, two on the left-hand side of the subassembly 3 and two on the right-hand side of the subassembly 3, are used to mechanically secure the subassembly 3 to the housing 2. In order to prevent electrical contact between the screws 5 and the subassembly 3, i.e. to provide electrical insulation of the subassembly 3 from the housing 2, e.g. insulting means 8, in particular in the form of plastic washers, are arranged between the screw heads on the subassembly 3 and the subassembly 3.

To provide electrical insulation, ceramic spacer elements 6 are arranged between the housing 2 and the subassembly 3. The spacer elements 6 can likewise be produced in the form of circular washers, or produced in the form of hollow cylindrical sleeves. In particular circular, continuous openings along the central axis of the spacer elements 6 allow the screws 5 to be passed through the spacer elements 6, i.e. the screws 5 are passed through the spacer elements 6 and the spacer elements 6 physically encompass a region of the screws 5. The thickness or height of the spacer elements 6 and of the bushes 4 together determine the distance of the subassembly 3 from the housing 2. On the side of the subassembly 3 facing the housing 2, the spacer elements 6 electrically insulate the subassembly 3 from the housing 2. On the side of the subassembly 3 away from the housing 2, the insulating means 8, in particular in the form of plastic washers, electrically insulate the subassembly 3 from the housing 2 and the screws 5 from the subassembly 3.

To electrically insulate the screws 5 in the region of the passage through the subassembly 3 from the subassembly 3, the screws 5 can have an insulating coating, e.g. comprising Teflon, and/or the passage has a substantially larger diameter than the screw shank and the screws 5 are routed centrally through the passage, and/or the passage has an insulating coating, e.g. lacquer, and/or the ceramic spacer elements 6 have at least two diameters, one larger and one smaller diameter, than the passage, the spacer elements 6 protruding into or through the passage with the smaller diameter or in the tapered region. This allows good electrical insulation between the subassembly 3 and the housing 2 via the ceramic spacer elements 6.

The contact surface, in particular the bearing surface, of the subassembly 3 on the spacer elements 6, and the contact surface, in particular the bearing surface, of the spacer elements 6 on the housing 2 or the bushes 4 of the housing 2, provide good thermal conduction. Heat produced on or in the subassembly 3 e.g. by large currents in the region of a few thousand amps and the contact resistances and/or the conduction resistance of the subassembly 3 is transferred to the housing 2 via the thermally conductive ceramic spacer elements 6. The large outer surface of the housing 2 effectively emits the heat to the environment. As a result, standard values for the maximum temperature of the connections 3 of the high-voltage device 1 are achievable for very large currents.

The exemplary embodiments described above can be combined with one another and/or can be combined with the prior art. As such, there can be provision for precisely one ceramic spacer element 6, or there can be provision for multiple ceramic spacer elements 6. The ceramic spacer elements 6 are e.g. made of an aluminum oxide, silicon carbide, boron nitride or aluminum nitride ceramic. It is also possible for other ceramics to be used, in particular having a high specific electrical resistance and a high thermal conductivity. The insulating means 8 can consist of plastic washers or likewise electrically insulating ceramic and can act analogously to the ceramic spacer elements 6. There can be provision for bushes 4, or it is possible for securing means 5, in particular screws, to be introduced or screwed directly into the housing wall. The subassembly 3 can be angled, or e.g. in shallow plate-shaped form without angles, in particular with a rectangular, round or elliptical base. High-voltage devices 1 can be e.g. current transformers, voltage transformers, combined instrument transformers, instrument transformers for gas-insulated switchgear, optical transformers and/or high-voltage switches.

LIST OF REFERENCE SIGNS

1 High-voltage device, in particular instrument transformer
2 Housing
3 Electrically insulated subassembly
4 Bush
5 Securing means, in particular screw
6 Ceramic spacer element, in particular ceramic disk
7 Electrical contact-connection element into the housing, in particular screw
8 Insulating means, in particular plastic washers

The invention claimed is:

1. A high-voltage device, comprising:
an instrument transformer of the high-voltage device for at least one of voltages up to 1200 kV or a few thousands amps;
a housing;
at least one subassembly electrically insulated from said housing, said at least one subassembly being spaced apart from said housing and mechanically connected to said housing; and
at least one ceramic spacer element disposed between said housing and said at least one subassembly;
said at least one ceramic spacer element being a ceramic disk formed as a circular washer.

2. The high-voltage device according to claim 1, wherein said at least one ceramic spacer element has a high electrical resistance and a high coefficient of thermal conductivity.

3. The high-voltage device according to claim 1, which further comprises a securing device securing said at least one subassembly to said housing.

4. The high-voltage device according to claim 3, wherein said securing device includes screws electrically insulated from said at least one subassembly.

5. The high-voltage device according to claim 1, which further comprises at least one element of the high-voltage device, and at least one electrical contact-connection element for making electrical contact between said at least one subassembly and said at least one element of the high-voltage device inside said housing.

6. The high-voltage device according to claim 5, wherein said at least one electrical contact-connection element is at least one screw.

7. The high-voltage device according to claim 1, wherein said at least one subassembly being electrically insulated from said housing includes at least one connecting element for connecting at least one of electrical or conductor rails.

8. The high-voltage device according to claim 7, wherein said at least one connecting element is configured for electrical connection to at least one of electrical supply system lines, electrical loads or electricity generators.

9. The high-voltage device according to claim 1, wherein said at least one subassembly electrically insulated from said housing includes at least one plate-shaped element.

10. The high-voltage device according to claim 9, wherein said at least one plate-shaped element is at least one of a parallelepipedal plate or an L-shaped element made up of plate-shaped elements.

11. The high-voltage device according to claim 1, wherein said at least one subassembly being electrically insulated from said housing is made of copper or steel or includes at least one of copper or steel or metal alloys.

12. The high-voltage device according to claim 1, wherein said housing is cylindrical and is made of cast iron or includes cast iron.

13. The high-voltage device according to claim 1, wherein said at least one ceramic spacer element is at least one of made of an aluminum oxide, silicon carbide, boron nitride or aluminum nitride ceramic or includes an aluminum oxide, silicon carbide, boron nitride or aluminum nitride ceramic.

14. A method of using a high-voltage device, the method comprising the following steps:

providing a high-voltage device being an instrument transformer for at least one of voltages up to 1200 kV or a few thousands amps, the high-voltage device including:

a housing;

at least one subassembly electrically insulated from the housing, the at least one subassembly being spaced apart from the housing, being mechanically connected to the housing and having connecting elements; and at least one ceramic spacer element disposed between the housing and the at least one subassembly, the at least one ceramic spacer element being a ceramic disk produced as a circular washer;

transferring heat produced on the connecting elements of the at least one subassembly from the at least one subassembly to the housing through the at least one ceramic spacer element; and emitting the heat from the housing to the environment.

15. The method according to claim 14, which further comprises using the at least one subassembly for connecting at least one of electrical lines or conductor rails.

16. The method according to claim 14, which further comprises providing electrical contact between the at least one subassembly electrically insulated from the housing and elements in the housing through at least one electrical contact-connection element.

17. The method according to claim 16, which further comprises providing transformer parts as the elements in the housing.

18. The method according to claim 16, which further comprises providing at least one screw as the at least one electrical contact-connection element.

19. The method according to claim 16, wherein the at least one electrical contact-connection element has a current-carrying capacity in a range of a thousands of amps.

* * * * *